US005467915A

United States Patent [19]

Mattson

[11] Patent Number: 5,467,915

[45] Date of Patent: Nov. 21, 1995

[54] LIFT-UP HANDLE

[75] Inventor: Larry J. Mattson, Charlotte, N.C.

[73] Assignee: Roberts Systems, Inc., Charlotte, N.C.

[21] Appl. No.: 166,640

[22] Filed: Dec. 14, 1993

Related U.S. Application Data

[63] Continuation-in-part of Ser. No. 964,790, Oct. 21, 1992, abandoned.

[51] Int. Cl.[6] ..... B65D 5/465

[52] U.S. Cl. ..... 229/117.24; 215/396; 220/768; 220/770

[58] Field of Search ..... 206/150; 229/117.24, 229/117.12, 117.13, 117.19; 220/768, 770, 775, 776; 383/13, 17; 215/100 A; 16/110.5, 114 R, 124

[56] References Cited

U.S. PATENT DOCUMENTS

| | | | |
|---|---|---|---|
| 1,171,228 | 2/1916 | Misroch et al. . | |
| 2,639,082 | 5/1953 | Goldsmith . | |
| 3,258,288 | 6/1966 | Courter | 206/151 X |
| 3,269,530 | 8/1966 | Wanderer | 206/150 |
| 3,315,876 | 4/1967 | Vander Jagt . | |
| 3,774,836 | 11/1973 | Nunn . | |
| 3,801,012 | 4/1974 | Thelen . | |
| 4,269,308 | 5/1981 | Platt . | |
| 4,269,314 | 5/1981 | Barrash . | |
| 4,286,714 | 9/1981 | Zdarsky et al. . | |
| 4,396,128 | 8/1983 | Larson et al. . | |
| 4,498,620 | 2/1985 | Dickert et al. . | |
| 4,779,731 | 10/1988 | Fujio . | |
| 4,819,410 | 4/1989 | Skinner et al. . | |
| 5,052,165 | 10/1991 | Gunther . | |
| 5,079,900 | 1/1992 | Pinckney et al. . | |
| 5,106,015 | 4/1992 | Vlasaty et al. . | |

FOREIGN PATENT DOCUMENTS

| | | | |
|---|---|---|---|
| 1337049 | 12/1963 | France . | |
| 1429884 | 1/1966 | France | 229/117.12 |

*Primary Examiner*—Allan N. Shoap
*Assistant Examiner*—Christopher J. McDonald
*Attorney, Agent, or Firm*—Hardaway Law Firm

[57] ABSTRACT

A flexible handle for a container having unitary construction which has a substantially flat profile with a strap attached to flexible hinges and which can be secured flush with a surface of a container.

11 Claims, 4 Drawing Sheets

LIFT-UP HANDLE

This application is a continuation-in-part of U.S. application Ser. No. 07/964,790, filed Oct. 21, 1992, abandoned.

BACKGROUND OF THE INVENTION

This invention is directed towards a handle for containers.

In recent years there has been growing economic pressure to reduce the cost of packaging goods and materials. This goal is often achieved by reformulating products into a denser product configuration so that the product occupies a smaller package.

As container size is reduced with a corresponding increase in product weight, there is a need for both stronger handles as well as improved handle attachment means. Some attachment means, such as rivets, are quite strong but interfere with the recycling of the container. In addition, such attachment means/handles increase the local thickness of the package. Even a minor increase in thickness interferes with the stacking of flat container stock as well as stacking of the assembled package.

The prior art provides packaging handles which have a compact shipping profile. However, once these handles are engaged, the handle creates a raised package profile which will not readily resume its former configuration. Such handles cannot be used by retailers for stocking such products since, once engaged, the handles take up valuable shelf space. Further, such handles use attachment means which require opening in the container flaps. Such openings are prone to product leakage and/or contamination of the container contents. Therefore, there is need and room for improvement within the art of container handles.

SUMMARY OF THE INVENTION

It is thus an object of this invention to provide a handle which can be secured flush with a surface of a container.

It is a further object of this invention to provide a handle which can resume a substantially flat profile after repeated use.

It is still a further and more particular object of this invention to provide a handle and attachment means which does not increase the outer dimensions of the package.

It is still a further and more particular object of this invention to provide a handle having unitary construction.

It is still a further and more particular object of this invention to provide a handle which distributes engagement forces along a broad area of a handle as well as the associated container.

It is still a further and more particular object of this invention to provide a handle which has flexible shock-absorbing hinges which resist tearing.

It is still a further and more particular object of this invention to provide a handle with attachment means which does not pose a risk of leakage or contamination of the container contents.

It is still a further and more particular object of this invention to provide a handle and process of installing a handle which does not interfere with the closure of a container.

These as well as other objects of this invention are provided by a handle comprising a substantially thin, planar platform, the platform having a top, a bottom, an outer perimeter and an inner region, the platform further defining an opening providing communication between a top platform surface; a strap traversing the opening and having a first end and a second end, the first end and second end attached to flexible hinges at each of the respective strap ends; wherein the handle is fastened to a container, the opening providing access to the strap, the flexible hinge permitting the strap to be reversibly gripped.

DETAILED DESCRIPTION

Figure 1:
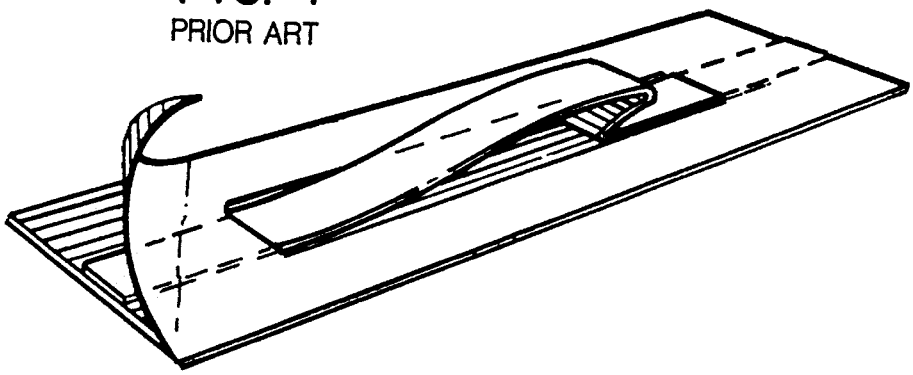
FIG. 1 PRIOR ART
FIG. 1 of the drawings is a perspective view of a prior art handle used with paste board boxes.

FIG. 1 is an example of a prior art handle as commonly used in conjunction with a paste board box. The prior art handle has a plastic strap which is glued between two or more layers of a fabric web. The strap is folded along an exposed portion of its length and glued in place along the webbed layers' upper surface. When engaged, the exposed portion of the strap becomes detached from the fabric surface and is free to be gripped. However, once engaged, the loose strap hinders further retail handling of the container.

In accordance with this invention, it has been found that a handle for packages can be provided which offers many advantages over handles of the prior art. The handle can be manufactured from a readily recyclable material, such as plastic, has a slim profile, can be mounted within a recessed notch provided by a container, does not interfere with stacking or shipping of the containers and, once engaged, the handle can be readily collapsed so as to resume its original recessed profile.

Figure 2:
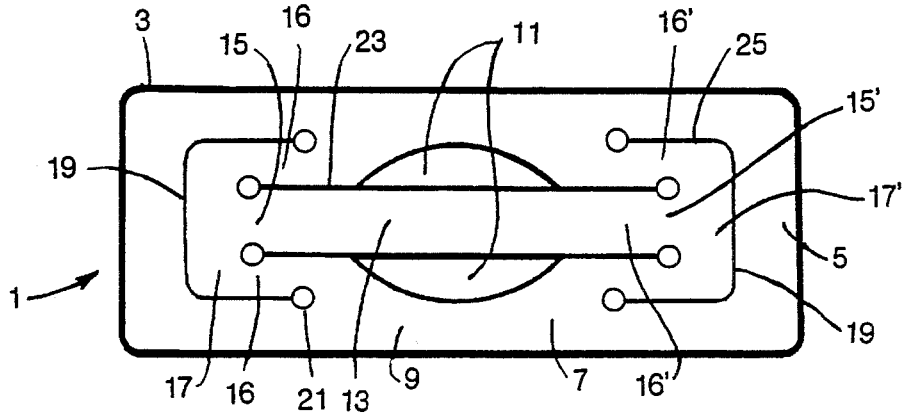
FIG. 2 of the drawings is an elevational view of a preferred embodiment of this invention.

As seen in FIG. 2, a preferred embodiment of handle 1 is comprised of a thin, planar rectangular platform 3 constructed of a unitary piece of tear resistant polymer such as recycled polyethylene and which is die cut into the desired shape. Platform 3 defines an outer perimeter area 5, a top surface 7, a bottom surface 9 (best seen in FIG. 3), and an oblong opening 11 provided between the top and bottom surfaces. Traversing the opening 11 is a strap 13 which is connected at respective strap ends 15 and 15' to identical flexible hinges 17 and 17'.

Figure 3:
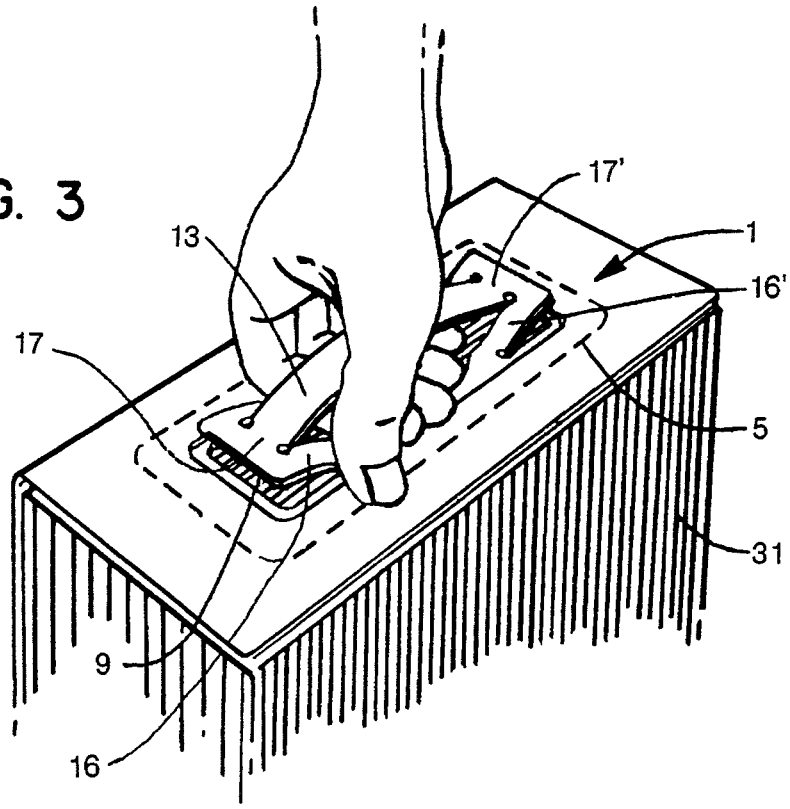
FIG. 3 of the drawings is a perspective view of the embodiment of this invention showing features of the flexible hinges and strap.

Hinges 17 and 17' are defined within platform 3 through a U-shaped score line 19 which perforates the platform. Score line 19 permits the hinges to be reversibly flexed upwardly above the plane of platform 3 as seen in FIG. 3.

Each end of score line 19 terminates in a circular hinge aperture 21 which helps to distribute forces exerted upon the hinge, thereby preventing tearing of the platform along the continuation of the score line. A pair of webs, 16 and 16', connect each hinge to the platform interior.

Strap 13 is further defined by a series of two additional perforating score lines 23, each end of such score line terminating in a circular strap aperture 25. Strap apertures 25 provide a similar function as hinge apertures 21. As best seen in FIG. 3, the score lines 19 and 23 permit strap 13 to be elevated from the surface of platform 3. Hinges 17 and 17' enable additional upward movement, increased flexibility, and permit slight torsion of the strap relative to the platform.

Figure 4:
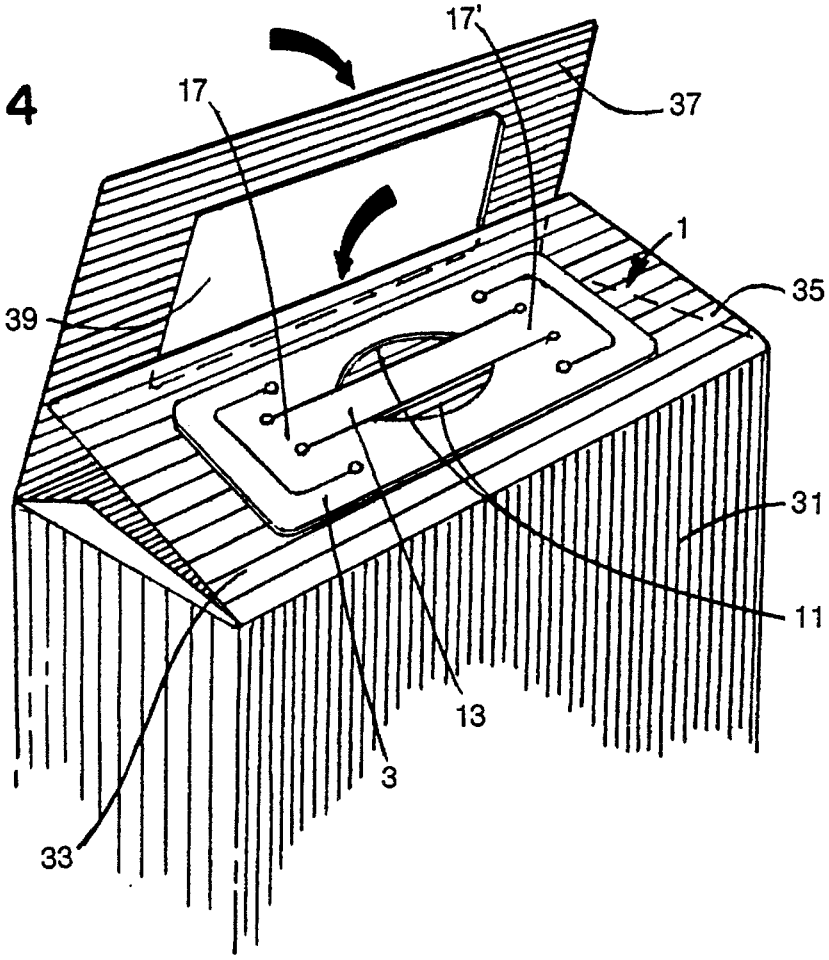
FIG. 4 of the drawings is a perspective view of a preferred embodiment of the handle attached to a paste board box.

Handle 1 can be used with rigid containers such as paste board boxes. In addition, the present invention is well suited for attachment to an exterior of flexible packaging material such as soft courier packages, duffle type bags, and other non-rigid packaging. In many circumstances, the bottom surface of handle 1 can be glued directly to the exterior of a rigid container as well. Further, directly taping the handle in place provides a strong attachment means for many applications. In FIG. 4, a preferred attachment method of handle 1 is seen where handle 1 is secured to a container 31 in cooperation with at least one pair of overlapping closure flaps. A lower most flap 35 provides a surface on which the bottom of handle 1 is placed. The upper most flap 37 defines a rectangular opening 39 having dimensions so that when flap 37 is folded against flap 35, the edges of opening 39 engage the outer perimeter 5 of handle platform 3. An adhesive applied between the upper platform perimeter 5 and the corresponding engaging portion of flap 37 provides a strong securing means for fastening a handle to a container. If needed, additional adhesive can be applied to the bottom of handle 1 as well.

Figure 5:
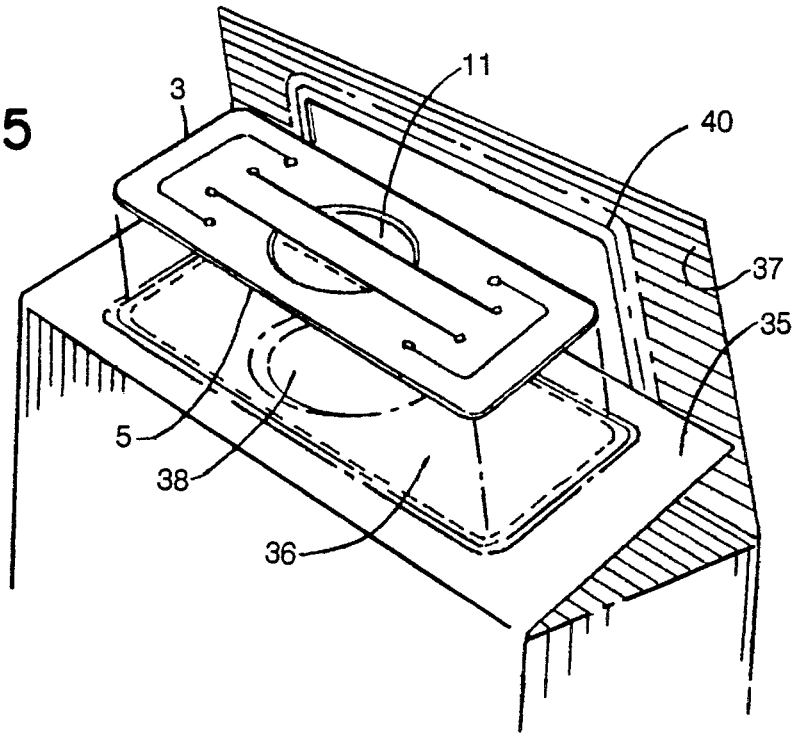
FIG. 5 of the drawings is an exploded perspective view, showing additional features of the present invention.

As best seen in FIG. 5, it is desirable to deboss flap 35, thereby providing a debossed region 36 which generally corresponds to the dimensions of platform 3. Debossed region 36 allows platform 3 to be situated nearly flush with the surface of flap 35. This permits flap 35 and flap 37 to be tightly secured to each other without interference from the thickness of handle 1.

Similarly, upper flap 37 can be debossed along region 40 to further assist in permitting an efficient seal between flaps 37 and 35. A further debossed region 38 of flap 35 can be provided in the vicinity of opening 11, thereby permitting easier access to strap 13.

When handle 1 is mounted in this manner, strap 13 and hinges 17 and 17' are accessible and flexible through flap opening 39 as best seen in FIG. 3. The platform opening 11 and debossed region 38 of flap 35 provides the user with finger access to strap 13 so that carton 31 may be lifted by the strap. When so lifted, hinges 17 and 17' are free to flex upwardly along with strap 13. Even flexible packages can be provided with a recessed region which enables a handle 1 to be mounted flush with the packaging surface.

A desirable feature of the attachment method seen in FIGS. 4 and 5 is that the handle 1 has a thin profile which can be completely recessed within flap opening 39. With no exposed profile, the handle permits containers to be stacked and shipped in an economical fashion. If the handle is engaged or used by a shipper or retail handler, the handle, upon being stacked with other containers, will readily resume its recessed profile to facilitate stacking of the retail inventory.

The present invention provides a thin, flexible and strong handle which can be used with a variety of containers. When the above description is given in reference to a handle fitted within an opening of a flap of a cardboard box, the handle can be readily secured directly to a container's outer surface. Further, the handle can be placed at other locations such as the side of a container.

Figure 7:
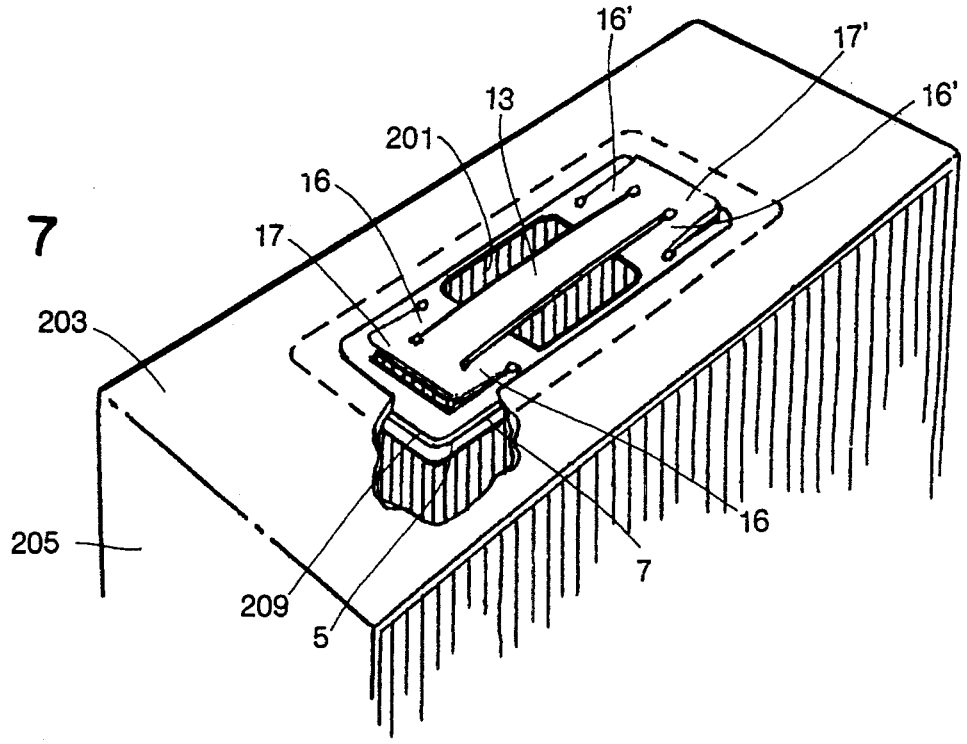
FIG. 7 of the drawings is a perspective view in partial phantom of an additional embodiment of the handle shown attached to a beverage carton.

Other containers such as a twelve-pack beverage package are also suited to the present invention. As best seen in FIG. 7, an additional embodiment utilizing handle 1 is seen attached within an opening 201 defined by surface 203 of a beverage package 205. For clarity of detail, strap 13 and hinges 17 and 17' are shown slightly elevated above the plane of the container surface 203 indicating the relative position of handle 1 to opening 201.

As seen in FIG. 7, handle 1 is positioned within opening 203 so that the top surface 7 of outer perimeter 5 engages the interior container surface surrounding opening 203. An adhesive 209 can be used to attach handle 1 to the interior of container 205. However, other well known attachment means such as rivets or adhesive tape can also be employed.

It has been found that the attachment of the present invention to the exterior of a container enables a strong bond which has a high sheer strength. The flexible hinges help distribute forces along a broad region of the handle and contribute to the sheer strength qualities of the attached handle.

Figure 6:
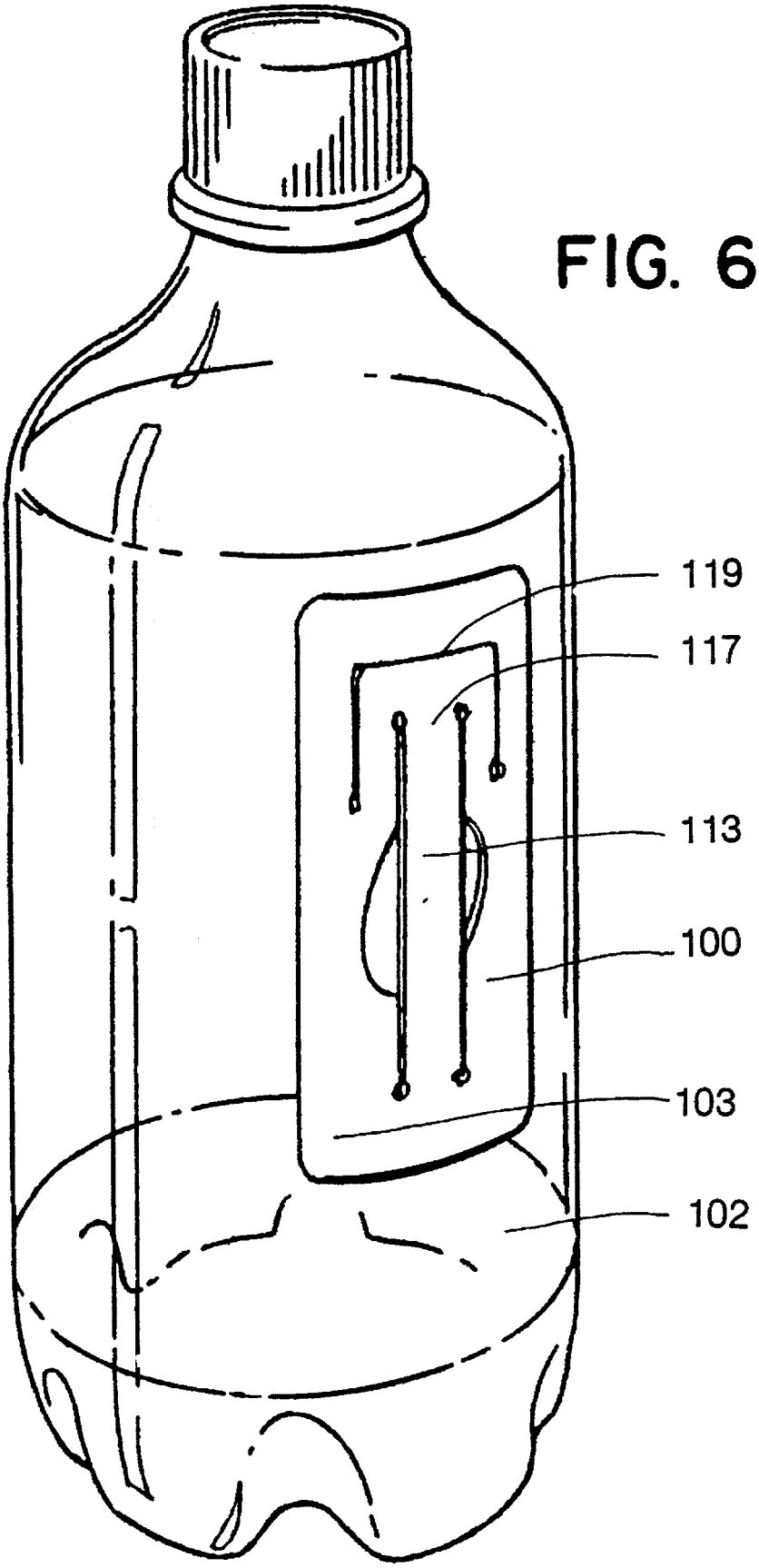
FIG. 6 of the drawings is a perspective view of an additional embodiment of the handle shown attached to the exterior of a plastic beverage container.

Handle 1 is well suited for attaching to the exterior of a container such as a two or three liter soft-drink container. As best seen in FIG. 6, an additional embodiment of the invention is a handle 100 similar to that described above, but which has only a single hinge 117 connecting strap 113 to platform 103. The single hinge is located along the upper end of a bottle so that when the bottle is grasped by strap 113, the single hinge flexes and distributes the bottle weight along the handle. The single hinge helps maintain an upright and balanced bottle presentation which allows the handle to be used in pouring.

As seen in FIG. 6, when handle 100 is placed on the exterior of an arcuate surface, such as a curved bottle, strap 113 tends to be flexed outward which permits the handle the be easily grasped. If desired, handle 100 can be positioned within an embossed region of the bottle to permit a less obtrusive profile. Further, a portion of strap 113 could be tacked down with a weak adhesive, the adhesive releasing the strap when the strap is engaged. This arrangement would permit a much smoother bottle profile which may facilitate commercial shipping and handing.

The handle's desired features and unobtrusive attachment means are equally useful on other containers such as luggage. Recessed luggage handles reduce the risk of damage caused by exposed handles or straps getting hung up in baggage handling conveyors or with other bags.

While a preferred embodiment of the present handle is polyethylene or similar polymer for its strength and tear resistance, the handle can be constructed by a wide variety of materials as well as processes such as injection molding. When recycling of an entire package, including the handle, is desirable, it is possible to construct the handle of a material which is compatible with the container. For instance, for soft-drink cartons, a handle can be constructed of cardboard similar to the container materials, thereby providing a container and handle assembly which is of the same recyclable material.

Figure 8:
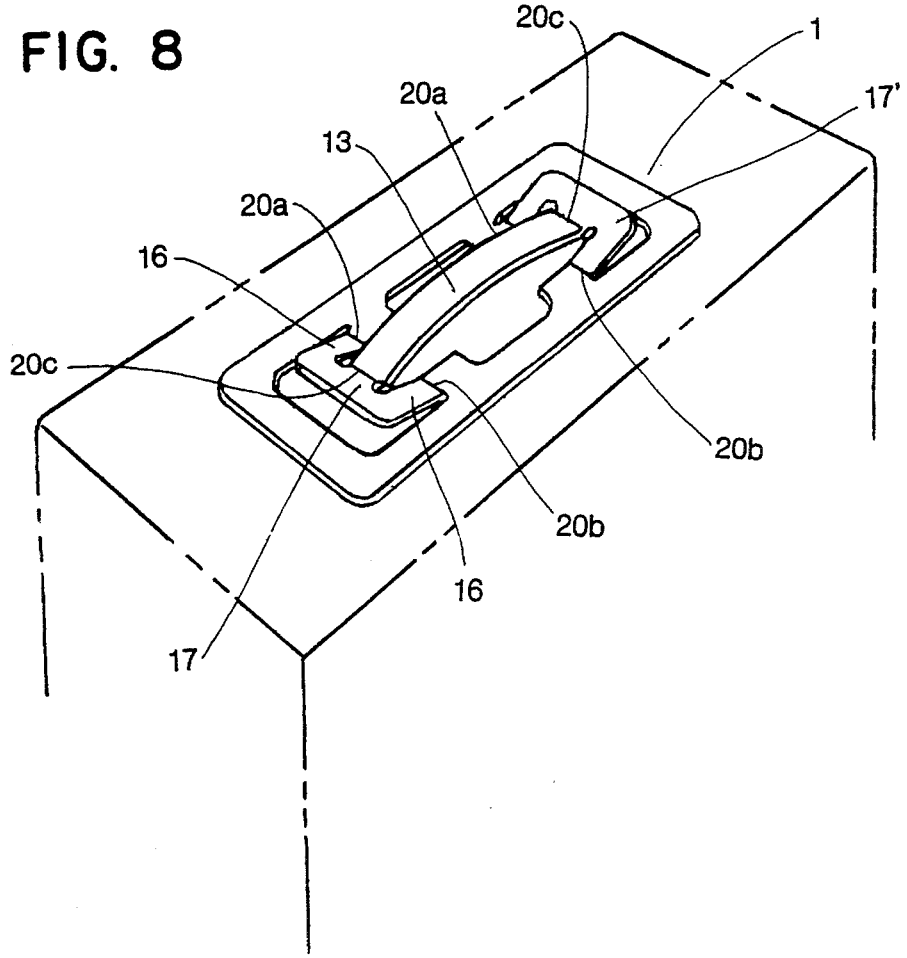
FIG. 8 of the drawings is a perspective view of an additional embodiment of the invention, the strap being partially elevated for the purposes of illustration.

An additional embodiment of this invention is seen in reference to FIG. 8. Similar to the embodiment of FIG. 2, this alternative embodiment further provides a series of hinge lines 20*a*, 20*b*, and 20*c*, made by partial scoring of the handle surface. As seen in FIG. 8, hinge lines 20*a* and 20*b*, are provided along the width of connecting webs 16 as well as an additional hinge line 20*c* along the juncture of strap 13 to each hinge 17.

The additional score lines gives a greater effective height to the lift-up handle. As a result, greater clearance between the engaged strap and the container surface is achieved which facilitates the handle's use. The greater clearance also permits a smaller overall handle to be used in some applications. The additional hinge lines also permit the preferred material of polyethylene to relax to its original planar configuration following handling.

An additional advantage of the hinge lines is that the initial set up of the handle is facilitated. In other words, when the consumer grasps the package or container having the lift-up handle seen in FIG. 8, the hinge lines permit the handle to more readily assume an engaged position. A further improvement is that the hinge lines reduce the amount of torsion or twist which is associated with the handle. Surprisingly, the reduction in the twist and torsion brought about by the hinge lines increased the failure strength of handles installed according to the teachings of this present invention.

The present handle has several advantages over that of the prior art. The present invention maintains the physical integrity of the container. No opening in the inner most flap is required to attach the handle, thereby eliminating a source of product leakage and/or contamination. Further, integral, flexible hinges distribute forces along a broad handle region including the middle portion of the handle. This is an advantage over prior art handles seen in FIG. 1 which direct forces to either terminus of the handle.

It is thus seen that the present invention provides a handle which is lightweight, capable of unitary construction, possesses flexible hinges and straps which efficiently distribute forces, can occupy a recessed position for storage, and provides an opening for ready access of the strap. As many variations are apparent to one of skill in the art from reading the above specification, such variations are within the spirit and scope of the instant invention as defined by the following appended claims.

That which is claimed:

1. A handle comprising:

a substantially planar platform, said platform having a top, bottom, an outer perimeter, and an inner region, said outer perimeter providing a securing surface for attaching said handle to a surface of a container;

a first hinge and a second hinge, said first and second hinges formed by first and second substantially U-shaped score lines, respectively, each said hinge having two parallel webs extending towards a center of said platform, each said web further defining a hinge line; and a strap extending from said first hinge to said second hinge, said strap being carried at each its ends between said parallel webs and each said strap end further defining a hinge line between said strap and said respective hinges.

2. A handle comprising:

a platform having an outer perimeter and an interior portion;

a flexible strap having a first end and a second end;

a first hinge in communication with said first strap end, a first strap score line connecting said first strap end to said first hinge;

a second hinge in communication with said second strap end, a second strap score line connecting said second strap end to said second hinge; and first and second hinge score lines connecting each said first hinge and said second hinge to said interior portion; whereby through said first and second strap score lines and said first and second hinge score lines, both ends of said strap are unitary with said platform.

3. A handle comprising:

a platform having an outer perimeter and an interior portion;

a flexible strap having a first end and a second end, said first end and said second end defining respective first and second terminal strap score lines, said strap being connected at each said end to a hinge, said hinges further connected by first and second hinge score lines to said interior portion of said platform.

4. The handle according to claim 3, wherein said first and second score lines are a fixed distance apart.

5. The handle according to claim 3, wherein said first and second hinge score lines are integral with said platform.

6. The handle according to claim 3, wherein when said handle is in a flat configuration, said first and second handle score lines are further from said interior portion of said platform than said first and second hinge score lines.

7. A handle for securing to a side of a plastic beverage container comprising:

a platform, said platform having a top, a bottom, an outer perimeter, and an inner region, said outer perimeter providing a securing surface for attaching said handle to a curved surface of a container, said platform engaging said container in an arcuate fashion;

a strap defined by said inner region, said strap traversing an opening within said platform, said opening providing communication between said top platform surface and said bottom platform surface, said strap further defining a first end and a second end, said first end attached to a flexible hinge, said hinge further connected by a pair of webs to said platform, wherein said second strap end is directly and integrally connected to said platform;

wherein when said platform is secured to said container, said opening provides access to said strap, said flexible hinge directing an engaging force along said pair of webs to said inner region.

8. A handle comprising:

a platform having an outer perimeter and an interior portion;

a flexible strap having a first end and a second end, said first end and said second end each defining a respective strap score line, each said strap score line being further connected to a respective first and second hinge, each said hinge further connected by a first web and a second web to an interior portion of said platform, each said first web and said second web defining a score line adjacent said interior platform portion.

9. A handle according to claim 8, wherein said strap score lines are integral with said respective hinges.

10. A handle according to claim 8, wherein said score lines of said first web and said second web are integral with said platform.

11. A handle according to claim 8, wherein said handle is integrally constructed from plastic.

* * * * *